United States Patent [19]

Asahina

[11] Patent Number: 4,985,908

[45] Date of Patent: Jan. 15, 1991

[54] DIGITAL FLUOROGRAPHY APPARATUS

[75] Inventor: Hiroshi Asahina, Tochigi, Japan

[73] Assignee: Kabushiki Kaisha Toshiba, Kawasaki, Japan

[21] Appl. No.: 443,858

[22] Filed: Nov. 30, 1989

Related U.S. Application Data

[63] Continuation of Ser. No. 327,391, Mar. 21, 1989, abandoned, which is a continuation of Ser. No. 199,871, May 27, 1988, abandoned, which is a continuation of Ser. No. 872,835, Jun. 12, 1986, abandoned.

[30] Foreign Application Priority Data

Jun. 15, 1985 [JP] Japan ..... 60-130466

[51] Int. Cl.[5] ..... H05G 1/64

[52] U.S. Cl. ..... 378/99; 378/116; 358/111

[58] Field of Search ..... 378/99, 101, 109, 110, 378/111, 112, 114–116; 358/111

[56] References Cited

U.S. PATENT DOCUMENTS

| | | | |
|---|---|---|---|
| 4,101,776 | 7/1978 | Mansfield et al. | 378/99 |
| 4,307,613 | 1/1982 | Brunn et al. | 378/112 |
| 4,354,112 | 10/1982 | Nishio | 378/111 |
| 4,543,605 | 9/1985 | Verhoeven | 378/99 |

FOREIGN PATENT DOCUMENTS

| | | |
|---|---|---|
| 3025107A1 | 1/1982 | Fed. Rep. of Germany . |
| 3119751A1 | 12/1982 | Fed. Rep. of Germany . |
| 3426932A1 | 5/1985 | Fed. Rep. of Germany . |

*Primary Examiner*—Carolyn E. Fields
*Assistant Examiner*—David P. Porta
*Attorney, Agent, or Firm*—Finnegan, Henderson, Farabow, Garrett, and Dunner

[57] ABSTRACT

A digital fluorography apparatus includes an X-ray tube, an X-ray/photo converter, an imaging system, an image processing unit, a display, a comparing unit, a fluorographic control unit, an imaging control unit, and an X-ray tube control unit. The converter opposes the tube to sandwich an object therebetween. An X-ray image formed by the converter is sensed by the imaging system. The image processing unit directly outputs image data sensed by the imaging system in a fluorography mode, and performs predetermined digital image processing of the image data and then outputs the resultant image data in an imaging mode. The image data output from the image processing unit in the fluorography mode is compared with reference data by the comparing unit, and a fluorographic control signal corresponding to the comparison result is generated from the fluorographic control unit. The imaging control unit generates an imaging control signal corresponding to the control data from the fluorographic control unit. The X-ray tube is driven under the X-ray radiation conditions corresponding to the control signals.

9 Claims, 7 Drawing Sheets

DIGITAL FLUOROGRAPHY APPARATUS

This application is a continuation of application Ser. No. 07/327,391, filed Mar. 21, 1989, which is a continuation of application Ser. No. 07/199,871, filed May 27, 1988, which is a continuation application of Ser. No. 06/872,835, filed June 11, 1986.

BACKGROUND OF THE INVENTION

The present invention relates to an apparatus used for X-ray diagnosis and, more particularly, to a digital fluorography apparatus which obtains an X-ray image and performs digital image processing of the obtained X-ray image.

A digital fluorography apparatus consists of an X-ray TV apparatus and a video-signal digital processing unit. The X-ray TV apparatus comprises an X-ray tube serving as an X-ray source for generating X-rays to be radiated onto an object; an image intensifier (to be referred to as an "I.I." hereinafter) which faces the X-ray tube and serves as an X-ray/photo converter for converting X-rays transmitted through the object into an optical image; a TV camera for imaging an output image from the I.I.; and a monitor for displaying an image imaged by the TV camera. Operation modes of the digital fluorography apparatus include a fluorography mode for observing a fluorographic image of an object inserted between the X-ray tube and the I.I. by means of a TV image displayed on the monitor, and an imaging mode for recording the fluorographic image of the object and performing digital image processing, if necessary. Therefore, in the digital fluorography apparatus, the desired portion of an object to be imaged is found upon fluorographic observation in the fluorography mode, and the imaging operation and image processing are performed when the operation mode is switched to the imaging mode.

Recent digital fluorography apparatuses have adopted a digital subtraction imaging method for extracting an image of a contrasted portion of an object through an arithmetic operation during, e.g., angiography (an imaging method for obtaining an X-ray image by injecting a contrast medium in a blood vessel). In this imaging method, image (mask image) data of a portion of interest before contrasting (before injection of a contrast medium) is subtracted from image data after contrasting (after injection of the contrast medium) so as to obtain, as an image, a difference between X-ray absorption values due to the presence/absence of the contrast medium. When the mask-image subtraction processing is performed with respect to a plurality of subsequent frames of a video signal after injection of the contrast medium, a plurality of image frames representing sequential flow of the contrast medium can be obtained. When a plurality of image frames are sequentially displayed, contrast medium flow can be observed as an animation. In order to obtain a processed image which can provide a high diagnostic effect with the above image processing method, the amount of light incident on the TV camera, which corresponds to an X-ray image converted into an optical image by the I.I., must be controlled to fall within the dynamic range of the TV camera.

In the digital subtraction imaging method, however, if an X-ray dose to the object is changed during imaging, an unnecessary image (an image indicating a change in dose and/or an image indicating a change in absorption characteristics due to the change in dose) caused by the change in dose appears during subtraction processing, resulting in an image having a poor diagnostic effect. For this reason, an X-ray dose to the object must be set at an optimal value before imaging takes place.

SUMMARY OF THE INVENTION

It is an object of the present invention to provide a digital fluorography apparatus which can set an optimal X-ray dose to an object before imaging takes place.

In order to achieve the above object of the present invention, a digital fluorography apparatus is characterized in that the X-ray radiation conditions are adjusted based on the relationship between fluorographic conditions and imaging conditions, which are preset to correspond with the thickness of an object, to allow X-ray imaging. Therefore, an X-ray tube voltage or current can be set in accordance with the thickness of the object, and a processed image having a high diagnostic effect can be obtained.

According to the present invention, the relationship between X-ray radiation conditions in a fluorography mode and optimal X-ray radiation conditions in an imaging mode for an object having the same thickness is predetermined, and X-ray imaging of the object can be performed under optimal X-ray radiation conditions which are determined in accordance with the thickness of the object and based oh the X-ray radiation conditions obtained through automatic adjustment in the fluorography mode. Therefore, an X-ray image which is subject to subtraction processing can provide a high diagnostic effect.

DETAILED DESCRIPTION OF THE PREFERRED EMBODIMENTS

A digital fluorography apparatus according to a first embodiment of the present invention will now be described with reference to FIG. 1.

Figure 1:
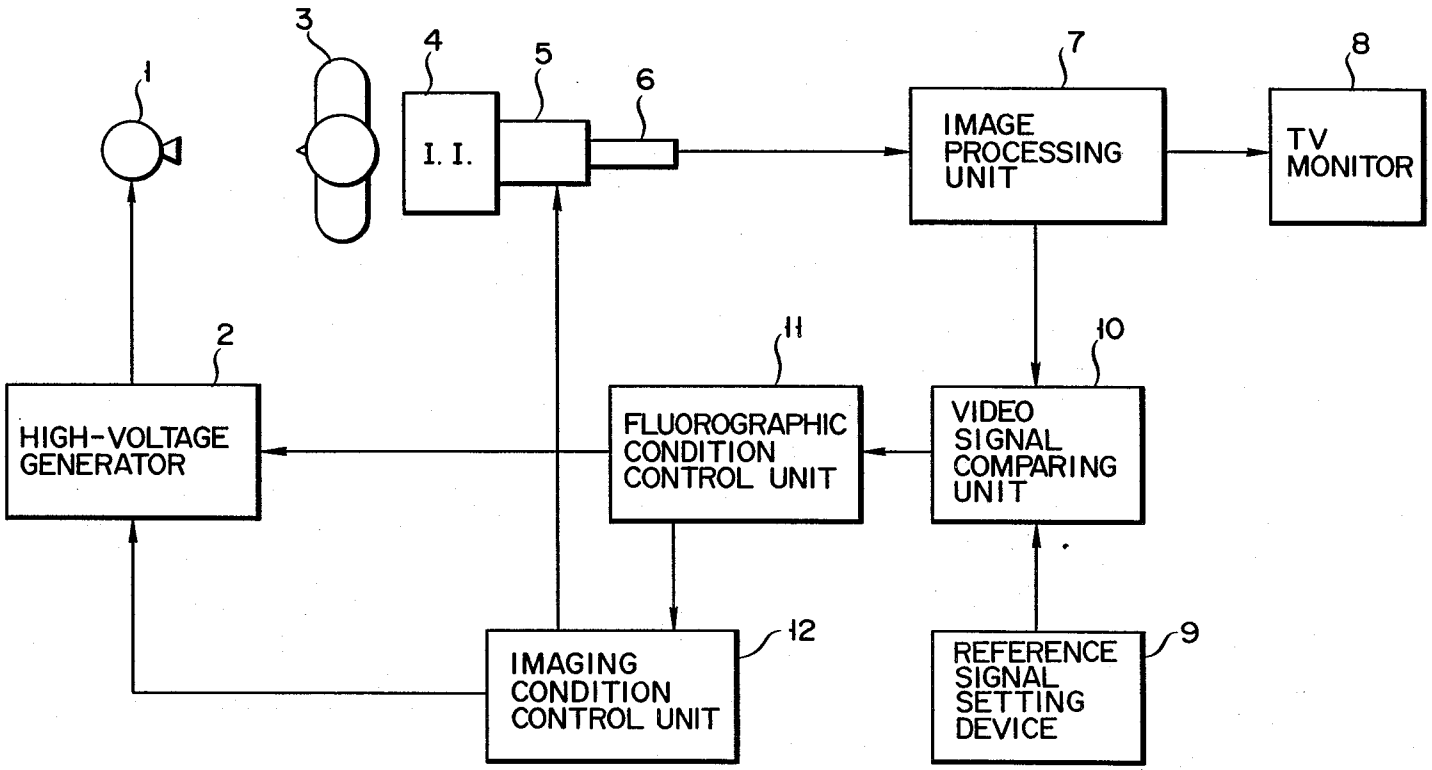
FIG. 1 is a block diagram of a digital fluorography apparatus according to a first embodiment of the present invention.

As shown in FIG. 1, the digital fluorography apparatus comprises X-ray tube 1, high-voltage generator 2, I.I. 4, optical attenuator 5, TV camera 6, image processing unit 7, TV monitor 8, reference video signal setting device 9, video signal comparing unit 10, fluorographic condition control unit 11, and imaging condition control unit 12.

X-ray tube 1 is driven by a high voltage applied from high-voltage generator 2, and radiates X-rays toward object 3. X-rays transmitted through object 3 are converted into an optical image by I.I. 4, and the optical image is supplied to TV camera 6 through optical attenuator 5. Optical attenuator 5 comprises at least one optical attenuation filter detachably arranged midway along the optical path for the optical image extending from I.I. 4 to TV camera 6, and an optical aperture for focusing a light beam propagating along the optical path. Attenuator 5 can thus vary the amount of light carrying optical image data stepwise or continuously within a predetermined range upon manual operation or in response to a control signal. For example, an ND (neutral density) filter is used as the optical attenuation filter. Image processing unit 7 performs necessary image processing of a video signal obtained from TV camera 6. TV monitor 8 displays an image-processed video signal from unit 7 or a non-image-processed video signal as a visible image. Reference video signal setting device 9 produces a reference video signal level for obtaining an X-ray image having an appropriate contrast and density on TV monitor 8.

Figure 2:
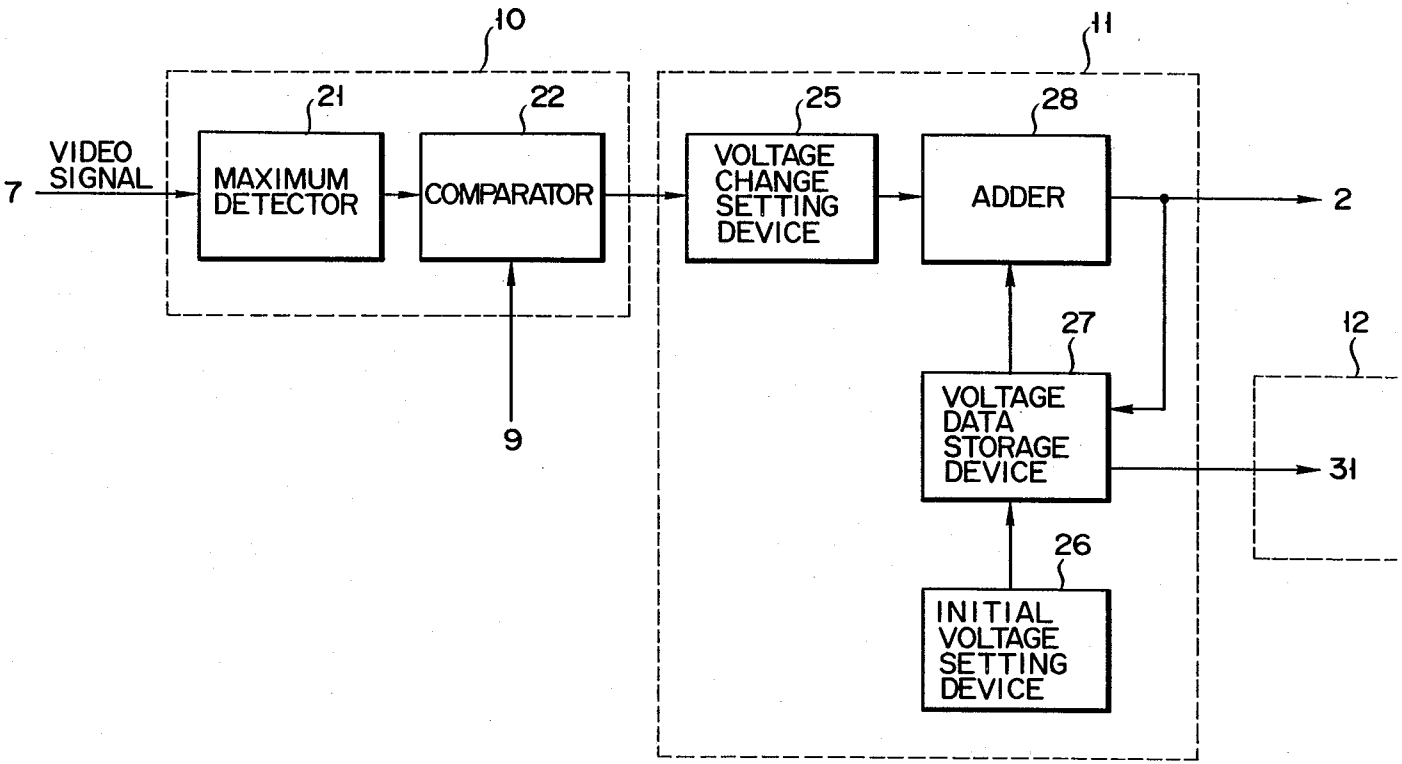
FIG. 2 is a detailed block diagram of a portion of the apparatus shown in FIG. 1.

Video signal comparing unit 10 consists of maximum value detector 21 and comparator 22, as shown in FIG. 2. Maximum value detector 21 detects the maximum value of a video signal supplied from TV camera 6 through unit 7. Comparator 22 compares the maximum value detected by detector 21 with a set value from setting device 9, and produces a signal corresponding to a difference therebetween.

The signal generated from comparing unit 10 (comparator 22 thereof), i.e., a signal corresponding to the difference between the maximum value detected by detector 21 and the set value from setting device 9, is supplied to fluorographic condition control unit 11.

Fluorographic condition control unit 11 is enabled in a fluorography mode, and controls the voltage from high-voltage generator 2 upon reception of the signal from comparing unit 10. More specifically, unit 11 comprises tube voltage change setting device 25, initial voltage setting device 26, voltage data storage device 27, and adder 28. Initial voltage setting device 26 supplies initial voltage data in the fluorography mode to storage device 27. Since the initial voltage set by device 26 is an initial value for automatic tube-voltage control, it need not be accurately determined, and is selected in advance by an operator in accordance with parameters such as the thickness of an object. Device 25 supplies data indicating an appropriate change amount of the voltage to adder 28 in response to the output from comparing unit 10. Adder 28 adds data stored in storage device 27 to the output from device 25 (if the output from device 25 is a negative value, the output therefrom is subtracted from the data stored in device 27). The sum from adder 28 is supplied to high-voltage generator 2 as a fluorographic tube voltage setting output. At the same time, the sum from adder 28 is stored in device 27, and is added to the next output from device 25.

Figure 3:
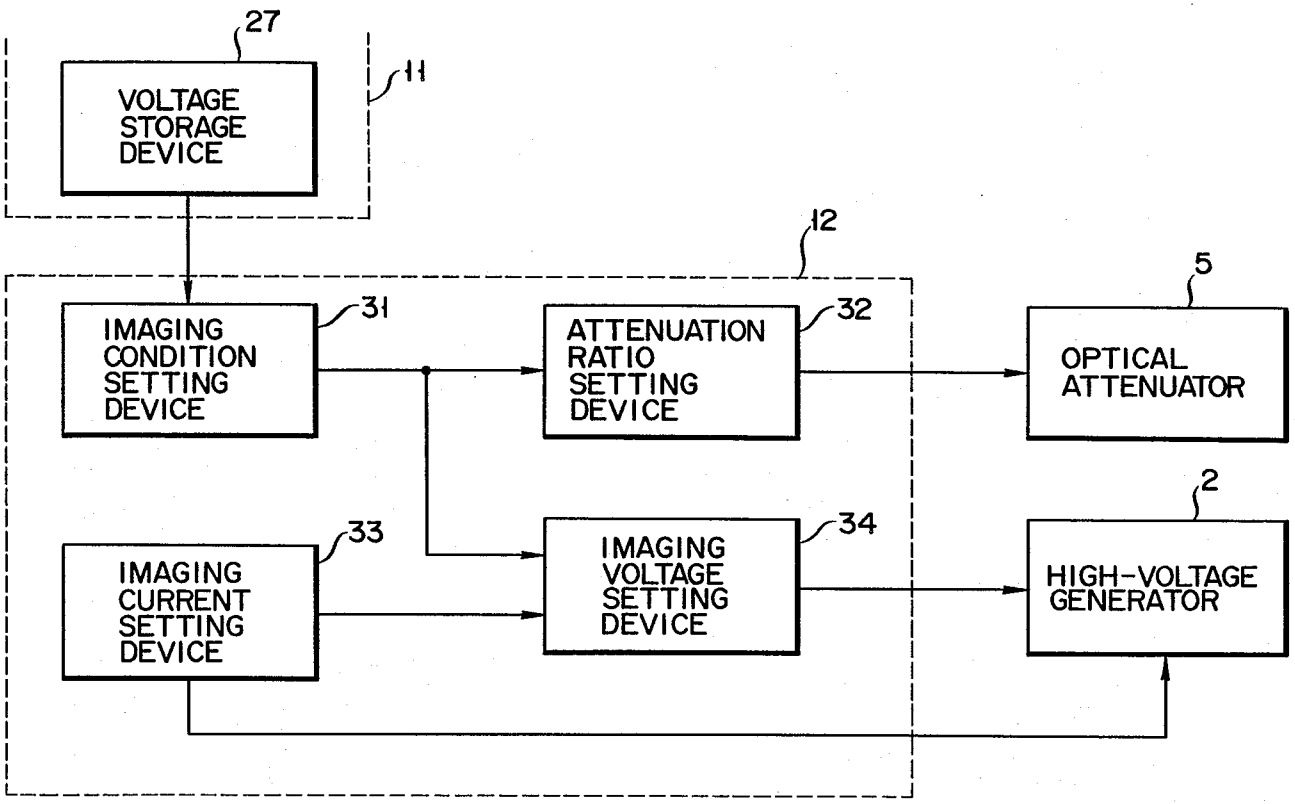
FIG. 3 is a detailed block diagram of another portion of the apparatus shown in FIG. 1.

Control unit 12 is enabled in the imaging mode, and controls high-voltage generator 2 in response to the storage content of device 27 of control unit 11, thus controlling a-voltage of X-ray tube 1 in the imaging mode. More specifically, control unit 12 comprises imaging condition setting device 31, attenuation ratio setting device 32, imaging tube current setting device 33, and imaging voltage setting device 34, as shown in FIG. 3.

In the imaging mode, setting device 33 supplies set data for an imaging current set in advance by manual operation to high-voltage generator 2. Condition setting device 31 produces parameter data corresponding to the thickness of object 3 based on fluorographic voltage data stored in device 27 of unit 11. Attenuation ratio setting device 32 stores a table for obtaining optimal attenuation ratio data of optical attenuator 5 that corresponds to parameter data in the imaging mode, and obtains the attenuation ratio data of attenuator 5 in response to the output data from device 31. Imaging voltage setting device 34 stores a table for obtaining an optimal imaging voltage corresponding to parameter data and imaging current data, and obtains optimal tube voltage data of high-voltage generator 2 in response to the parameter data supplied from device 31 and imaging tube current data supplied from device 33. The attenuation ratio data output from device 32 is supplied to attenuator 5, and the attenuation ratio of attenuator 5 is controlled accordingly. The imaging tube voltage data from device 34 is supplied to high-voltage generator 2 together with imaging current data from device 33, and X-rays are radiated in accordance with these data to perform an imaging operation.

The operation of the digital fluorography apparatus with the above arrangement will now be described.

The following control operation in the fluorography mode is performed using the initial fluorographic tube voltage set by device 26 of unit 11. X-rays are radiated from X-ray tube 1 by the high voltage supplied from generator 2. The X-rays radiated from tube 1 pass through object 3, and an image corresponding to the transmitted X-rays is converted into an optical image by I.I. 4. The optical image output from I.I. 4 is attenuated at an attenuation ratio manually set in optical attenuator 5 in advance, and is then supplied to TV camera 6. The optical image is converted into a video signal by TV camera 6, and is subjected to appropriate image processing by image processing unit 7 to be displayed on monitor 8. During the fluorography, the video signal generated from unit 7 is supplied to comparing unit 10. In unit 10, detector 21 first detects a maximum luminance level in the input image (one frame) from the video signal. The maximum luminance level is supplied to comparator 22. Comparator 22 also receives an optimal luminance level set in setting device 9, and compares it with the detected value. From the comparison result, comparator 22 supplies control unit 11 with a signal corresponding to a difference between the maximal value of the video signal and the optimal luminance level set in device 9. In control unit 11, setting device 25 supplies adder 28 with a control signal corresponding to a change amount of the voltage for making the maximum level of the video signal equal to the optimal luminance level set in device 9, in accordance with the signal supplied from comparator 22. Adder 28 adds the change amount to the voltage stored in storage device 27 (an initial value set by device 26), and the sum is supplied to high-voltage generator 2 as a voltage setting signal. The voltage setting signal is also supplied to storage device 27 to update the storage content thereof. In this way, automatic control of the fluorographic tube voltage by control unit 11 is performed. The storage content of device 27 is supplied to control unit 12 when the system is switched to the imaging mode, and is used to control imaging conditions.

Setting devices 32 and 34 of control unit 12 store the relationship (FIG. 4) between the fluorographic tube voltage and imaging voltage, which are obtained as follows.

Figure 4:
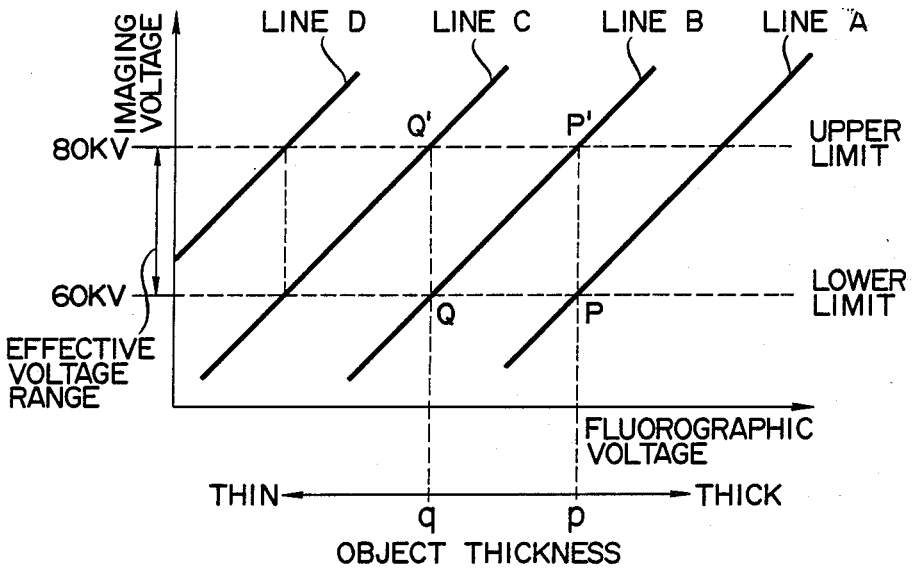
FIG. 4 is a graph showing the relationship between a fluorographic tube voltage and an imaging tube voltage in the apparatus shown in FIG. 1.

For the thickest object 3, the gain of a TV camera system consisting of I.I. 4, attenuator 5, TV camera 6, unit 7, and TV monitor 8 is adjusted so that the optimal imaging voltage of X-ray tube 1 coincides with the upper limit (e.g., 80 kV) of an effective imaging voltage range. In this state, different object 3 having different thickness are sequentially sampled to measure the relationship between the respective thicknesses of object 3 and the optimal voltage of X-ray tube 1, and the measured data is stored as a table corresponding to line A in FIG. 4. Next, thickness p of object 3, with which the optimal voltage of X-ray tube 1 is below lower limit P of the effective imaging voltage range (e.g., 60 kV), is obtained with reference to line A. The attenuation ratio of attenuator 5 between the output section of I.I. 4 and the incident section of TV camera 6 is adjusted to attenuate the amount of light incident on TV camera 6, so that the optimal voltage for object 3 having thickness p coincides with upper limit P' of the effective imaging voltage range. In this state, the relationship between thickness p of object 3 and the optimal tube voltage of X-ray tube 1 is measured, and the measured data is stored as a table corresponding to line B (FIG. 4). In addition, with reference to line B, thickness q of object 3, with which the optimal voltage of X-ray tube 1 is below lower limit Q of the effective imaging voltage range, is obtained. Again, the attenuation ratio of attenuator 5 is adjusted to attenuate an amount of light incident on TV camera 6, so that the optimal voltage of X-ray tube 1 for object 3 having thickness q coincides with upper limit Q' of the effective imaging voltage range. In this state, the relationship between thickness q of object 3 and the optimal imaging voltage is measured, and the measured data is stored as a table corresponding to line C (FIG. 4). Such relationships are sequentially obtained until the optimal imaging tube voltage of X-ray tube 1 for the thinnest portion of object 3 exceeds the lower limit of the effective imaging voltage range. The relationships shown in FIG. 4 are then stored in devices 32 and 34 of control unit 12 as tables for the optical attenuation ratio and the voltage, with the thickness of object 3 being a parameter.

When the system is switched from the fluorography mode to the imaging mode, the fluorographic tube voltage resulting from automatic control of unit 11 is stored in storage device 27. The thickness of given object 3 can be estimated from the fluorographic voltage when object 3 having an unknown thickness is subjected to fluorography and the fluorographic voltage is automatically controlled to make the luminance of the output image constant. The optimal voltage can thus be obtained from the estimated thickness of object 3, with reference to the relationship in FIG. 4. Therefore, when the system is switched from the fluorography mode to the imaging mode, the voltage stored in storage device 27 is converted into parameter data corresponding to the thickness of object 3 by setting device 31 of control unit 12. An imaging current is set in setting device 33 in advance by manual operation. The parameter data is supplied to setting device 32 to obtain an optical attenuation ratio corresponding to the thickness of object 3. The parameter data and the imaging current data are supplied to setting device 34 to obtain an imaging voltage. Attenuator 5 receives the attenuation ratio data obtained by setting device 32, and high-voltage generator 2 receives the imaging tube current data set by device 33 and imaging voltage data set by device 34. Therefore, the attenuation ratio of attenuator 5 in the TV camera system is set in accordance with the attenuation ratio data and, at the same time, X-ray tube 1 is driven by generator 2 at the voltage and current in accordance with the imaging voltage and current data. Upon X-ray radiation under these conditions, X-ray imaging and image processing are performed, thus obtaining an image having the highest diagnostic effect.

In the first embodiment, a case has been exemplified wherein mainly the voltage is controlled. Next, a second embodiment will be described wherein a voltage and a current are controlled at the same time.

Figure 5:
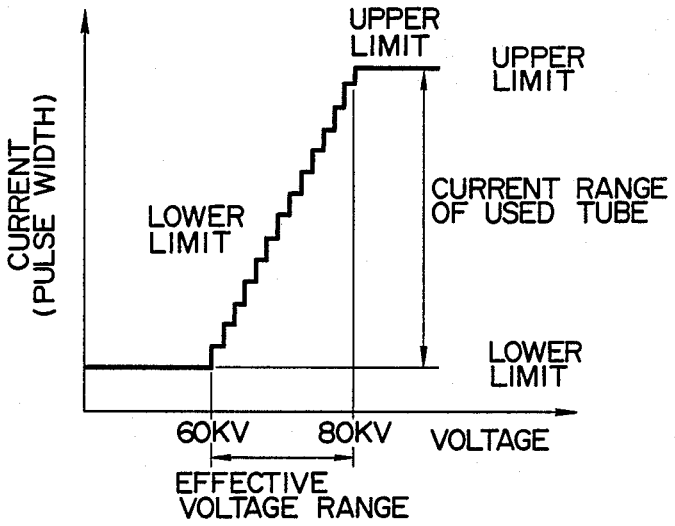
FIG. 5 is a graph for explaining a combinatorial function of a tube voltage and a tube current used in a digital fluorography apparatus according to a second embodiment of the present invention.

In the second embodiment, a combination of a voltage and a current is predetermined, and control is performed in accordance with this combinatorial function in an automatic condition setting mode. As shown in FIG. 5, in the combinatorial function, the voltage is gradually increased by minimum control units while the current is set at a lower limit value (minimum value) for actual application until it reaches the lower limit of the effective voltage range. Within the effective voltage range, after the current is increased by minimum control units (one or several steps), the voltage is increased by one minimum control unit (one step). The number of current steps corresponding to one step of the voltage is a value obtained by dividing the number of current steps from the upper to lower limit of the tube current with the number of voltage steps from the upper to lower limit of the effective voltage. Over the upper limit of the effective voltage range, the voltage is increased while the current is set at the maximum value.

Control of the imaging voltage and the current associated with the thickness of an object is performed in accordance with the above combinatorial function, so as to form tables for the optical attentuation ratio, the imaging voltage, and imaging current with respect to parameter data corresponding to the thickness of the object, as previously described. When both the voltage and current are controlled, a thickness range of object 3 within which optimal fluorography can be performed can be widened.

Figure 6:
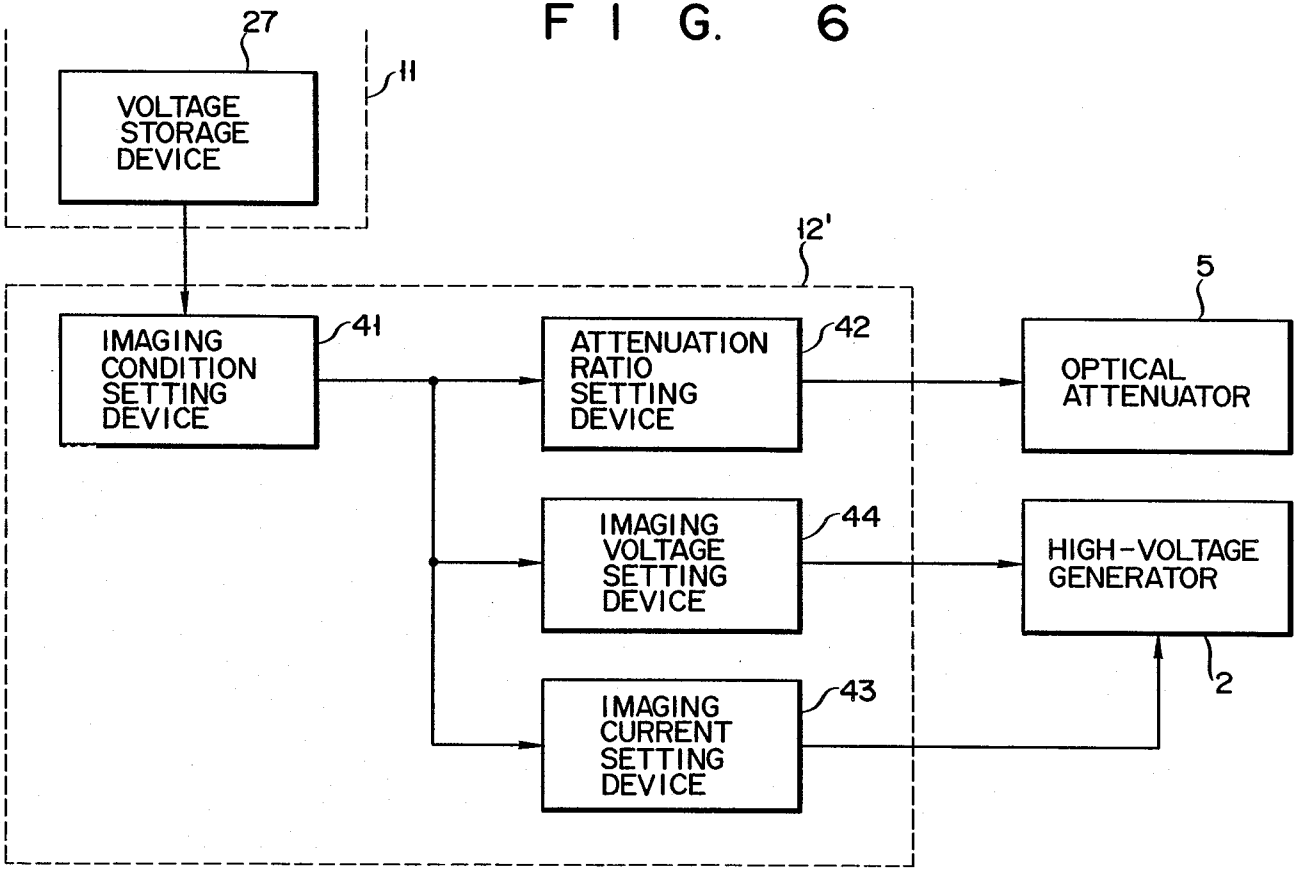
FIG. 6 is a detailed block diagram of a portion of the digital fluorography apparatus according to the second embodiment of the present invention.

In this case, in imaging condition control unit 12' shown in FIG. 6, parameter data output from imaging condition setting device 41 is commonly supplied to attenuation ratio setting device 42, imaging current setting device 43, and imaging voltage setting device 44, the attenuation ratio of optical attenuator 5 is controlled by device 42, and high-voltage generator 2 is controlled by devices 43 and 44.

Figure 7:
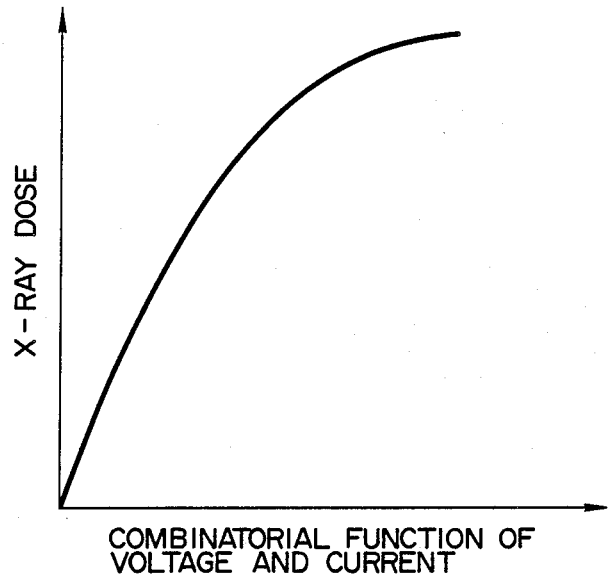
FIG. 7 is a graph showing changes in X-ray dose based on the combinatorial function shown in FIG. 5.
Figure 8:
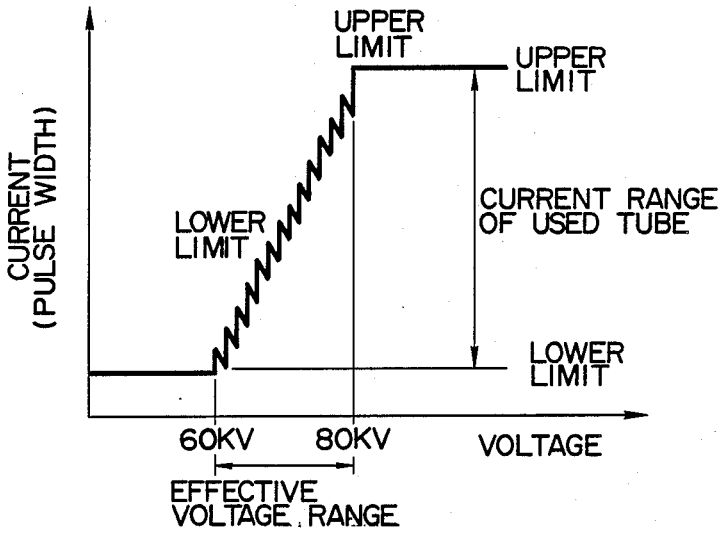
FIG. 8 is a graph for explaining a combinatorial function of a tube voltage and a tube current used in a digital fluorography apparatus according to a third embodiment of the present invention.
Figure 9:
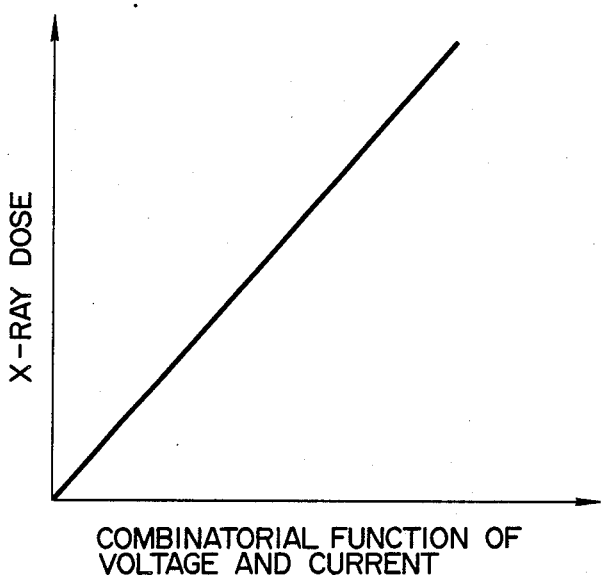
FIG. 9 is a graph showing changes in X-ray dose based on the combinatorial function shown in FIG. 8.

In a third embodiment of the present invention, a combinatorial function of a tube voltage and a current is determined so that an output X-ray dose increases linearly. In general, an X-ray dose changes exponentially in accordance with a voltage, and changes linearly in accordance with a current. For this reason, with the combinatorial function of the second embodiment, a change in dose can be generally expressed as shown in FIG. 7 (in practice, however, it is not expressed by a smooth curve but by complicated polygonal lines). In contrast to this, as shown in FIG. 8, when the current is decreased by a predetermined amount each time the voltage is increased by one step, a combinatorial function which allows linear increments of output dose can be formed, as shown in FIG. 9. When the combinatorial functions shown in FIGS. 8 and 9 are utilized for control in the imaging mode, the output dose can be smoothly controlled by simultaneously controlling the voltage and current. In this way, a thickness range of an object which allows fluorography can be widened, and optimal imaging can be realized for a variety of objects having various thicknesses.

The present invention is not limited to the embodiments described above and shown in the drawings, and various changes and modifications may be made within the spirit and scope of the invention.

For example, when a combinatorial function of a tube voltage and a current is used as in the second and third embodiments, an X-ray dose can be controlled over a wide range. Therefore, even if control of optical attenuator 5 in the imaging mode is omitted, a practical apparatus can be provided.

In the above embodiments, in the fluorography mode, automatic control is performed using a constant current while changing only a voltage. However, control by means of the combinatorial function of the tube voltage and current shown in FIG. 5 or 8 can be performed for controlling the fluorographic conditions. In this case, since an X-ray dose determined by the combination of the voltage and current in the fluorography mode corresponds with the thickness of an object, parameter data can be obtained from this X-ray dose. When fluorographic condition control using the combinatorial function of the voltage and current is performed, parameter data corresponding to the thickness of the object can be more precisely obtained than that obtained from only the voltage, which changes stepwise. Therefore, high-precision control can be realized.

In addition, the present invention is not limited to an apparatus of continuous X-ray radiation type, which continuously radiates X-rays, but can be applied to an apparatus of intermittent radiation type, which radiates X-ray pulses. In the apparatus of this type, a radiation time, i.e., a pulse width, can be controlled in place of control of a current, or in combination therewith.

What is claimed is:

1. A digital fluorography apparatus for imaging an object, said apparatus comprising:

X-ray generation means including an X-ray tube for illuminating the object with X-rays in accordance with a voltage and a current applied to said X-ray tube, and X-ray control means for controlling said voltage and current to said X-ray tube;

X-ray/photo converting means spaced from said X-ray tube to sandwich the object between said X-ray tube and said X-ray/photo converting means for converting said X-rays into light corresponding to an optical image of the object;

imaging means operatively coupled to said X-ray/-photo converting means for converting said light into a video signal, said imaging means including light amount adjusting means for adjusting the amount of said light received by said imaging means;

image processing means operatively coupled to said imaging means for processing said video signal, said image processing means having a fluorography mode in which said image processing means directly outputs said video signal, and an imaging mode in which said image processing means selectively processes said video signal to produce a processed video signal and outputs said processed video signal;

display means operatively coupled to said image processing means for displaying an image of the object in response to said processed video signal;

comparing means operatively coupled to said image processing means for comparing said video signal in the fluorography mode with a reference signal and for generating a difference signal corresponding to the difference of said video signal and said reference signal;

fluorographic control means operatively coupled to said comparing means and to said X-ray control means for generating a first control signal corresponding to said difference signal and providing said first control signal to said X-ray control means to control said X-ray tube voltage during said fluorographic mode; and imaging control means operatively coupled to said fluorographic control means, to said X-ray control means, and to said light amount adjusting means, for prestoring a plurality of voltage relationships between an object thickness and an imaging voltage for said X-ray tube, each of the voltage relationships corresponding to a unique setting for said light amount adjusting means, and for selecting a value of a second control signal from one of said voltage relationships in accordance with said first control signal and communicating said second control to said X-ray control means to control said voltage of said X-ray tube and to said light amount adjusting means to control said light amount adjusting means during said imaging mode.

2. An apparatus according to claim 1, wherein said imaging control means includes imaging mode current setting means coupled to said X-ray control means for prestoring a current relationship between the imaging voltage and an imaging current, and for selecting an imaging mode current setting from the current relationship in response to said first control signal and communicating said imaging mode current setting to said X-ray control means to control said X-ray tube current during said imaging mode.

3. An apparatus according to claim 1, wherein said imaging control means includes means for controlling at least one of said voltage and said current of said X-ray tube in stepwise increments and decrements.

4. An apparatus according to claim 1, wherein said comparing means compares a maximum value of a portion of said video signal with said reference signal.

5. An apparatus according to claim 1, wherein said fluorographic control means controls said voltage of said X-ray tube.

6. An apparatus according to claim 1, wherein said fluorographic control means controls said voltage and said current of said X-ray tube.

7. An apparatus according to claim 1, wherein said fluorographic control means controls said current of said X-ray tube.

8. A method for imaging an object with an apparatus that includes an X-ray tube having an effective imaging voltage range with upper and lower limits and a light amount adjusting device, the method comprising:

illuminating a sample with X-rays from the X-ray tube and setting the light amount adjusting device to a first setting at which an imaging voltage of the X-ray tube coincides with the upper limit of the effective imaging voltage range, and varying the imaging voltage from the upper limit to the lower limit to obtain a first functional relationship between a sample thickness and the imaging voltage for a first range of thickness values;

illuminating the sample with X-rays from the X-ray tube, setting the light amount adjusting device to a second setting different from the first setting at which the imaging voltage coincides with the upper limit, and varying the imaging voltage from the upper limit to the lower limit to obtain a second functional relationship between the sample thickness and the imaging voltage for a second range of thickness values different from the first range;

determining a thickness of the object;

selecting one of the first and second settings for the light amount adjusting device and an estimated imaging voltage using the object thickness and one of the first and second functional relationships; and illuminating the object with the X-ray tube at the estimated imaging voltage.

9. A method according to claim 8, further including varying a current to the X-ray tube in conjunction with the varying of the imaging voltage to obtain the first and second functional relationships.

* * * * *